US010882107B2

(12) United States Patent
Morris et al.

(10) Patent No.: US 10,882,107 B2
(45) Date of Patent: Jan. 5, 2021

(54) IMPACT PAD

(71) Applicant: VESUVIUS USA CORPORATION, Champaign, IL (US)

(72) Inventors: John Morris, Strongsville, OH (US); John Rogler, Pittsburgh, PA (US)

(73) Assignee: Vesuvius USA Corporation, Pittsburgh, PA (US)

( * ) Notice: Subject to any disclaimer, the term of this patent is extended or adjusted under 35 U.S.C. 154(b) by 41 days.

(21) Appl. No.: 16/320,516

(22) PCT Filed: Aug. 8, 2017

(86) PCT No.: PCT/US2017/045908
§ 371 (c)(1),
(2) Date: Jan. 25, 2019

(87) PCT Pub. No.: WO2018/031549
PCT Pub. Date: Feb. 15, 2018

(65) Prior Publication Data

US 2019/0275584 A1 Sep. 12, 2019

Related U.S. Application Data

(60) Provisional application No. 62/372,073, filed on Aug. 8, 2016.

(51) Int. Cl.
*B22D 41/00* (2006.01)

(52) U.S. Cl.
CPC ..... *B22D 41/003* (2013.01)

(58) Field of Classification Search
CPC ..... B22D 41/003
See application file for complete search history.

(56) References Cited

U.S. PATENT DOCUMENTS

| | | | |
|---|---|---|---|
| 5,169,591 | A | 12/1992 | Schmidt et al. |
| 5,662,823 | A | 9/1997 | Claar et al. |
| 5,882,577 | A | 3/1999 | Zacharias |
| 5,947,183 | A | 9/1999 | Schneider et al. |
| 6,533,992 | B1 | 3/2003 | Zacharias |

(Continued)

FOREIGN PATENT DOCUMENTS

| | | | |
|---|---|---|---|
| CN | 1178488 | A | 4/1998 |
| CN | 1190039 | A | 8/1998 |

(Continued)

OTHER PUBLICATIONS

Hadjuk M: "Impact Pad", Publikation Deutsches Patent—Und Markenamt, XX, XX, vol. 2003, Jan. 2004, pp. 40-44, XP002440519.

(Continued)

*Primary Examiner* — Scott R Kastler
(74) *Attorney, Agent, or Firm* — Thomas Clinton

(57) ABSTRACT

An impact pad for metallurgical processes is formed from refractory material, and contains a base having an impact surface facing upwardly against a stream of molten metal entering a vessel containing the impact pad. A wall having a plurality of adjacent wall portions extends upwardly from the base. The impact surface contains at least one nonhorizontal facet extending inwardly from a wall portion; all lines in the facet extending perpendicularly to the wall portion have an inclination or declination with respect to the horizontal plane.

8 Claims, 13 Drawing Sheets

(56) References Cited

U.S. PATENT DOCUMENTS

| | | | |
|---|---|---|---|
| 9,815,112 | B2 | 11/2017 | Hackl et al. |
| 2003/0183362 | A1 | 10/2003 | Zacharias et al. |
| 2004/0084172 | A1 | 5/2004 | Vincent et al. |

FOREIGN PATENT DOCUMENTS

| | | | | |
|---|---|---|---|---|
| CN | 1625451 | A | 6/2005 | |
| CN | 104955592 | A | 9/2015 | |
| EP | 0186852 | A2 | 7/1986 | |
| EP | 0847821 | A1 | 6/1998 | |
| EP | 2047928 | A1 * | 4/2009 | ..... B22D 41/003 |
| EP | 2537609 | A1 * | 12/2012 | ..... B22D 41/003 |
| UA | 96789 | U | 2/2015 | |
| WO | 9737799 | A1 | 10/1997 | |
| WO | 0074879 | A1 | 12/2000 | |
| WO | 2016025948 | A1 | 2/2016 | |
| ZA | 9710810 | B | 6/1988 | |

OTHER PUBLICATIONS

Anurag Tripathi and Satish Kumar Ajmani, "Effect of Shape and Flow Control Devices on the Fluid Flow Characteristics in Three Different Industrial Six Strand Billet Caster Tundish," ISIJ International (2011), pp. 1647-1656, vol. 51, No. 10, Iron and Steel Institute of Japan, Tokyo, Japan.

* cited by examiner

IMPACT PAD

CROSS-REFERENCE TO RELATED APPLICATIONS

This application is a U.S. national stage application, filed under 35 U.S.C. § 371, of International Application No. PCT/US17/45908, which was filed on Aug. 8, 2017, and which claims priority to U.S. Provisional Application Ser. No. 62/372,073, filed on Aug. 8, 2016, the contents of which are incorporated by reference into this specification.

BACKGROUND OF THE INVENTION

(1) Field of the Invention

The present invention relates to a refractory article known in the art as an "impact pad" for use in handling molten metals, especially steel. The invention particularly relates to an impact pad for placement in a tundish for reducing the effects of misalignment of an impinging stream of molten steel entering the tundish. The present invention finds particular utility in the continuous casting of steel.

(2) Description of the Related Art

Tundishes act as holding tanks for said molten metal, and especially for molten steel in commercial processes for the continuous casting of steel. In the continuous casting of steel, the molten steel fed to the tundish is generally high-grade steel that has been subjected to various steps for rendering it suitable for the particular casting application. Such steps normally involve, for example, one or more steps to control the levels of the various elements present in the steel, for example the level of carbon or other alloying ingredients, and the level of contaminants such as slag. The residence of the steel in the tundish provides a further opportunity for any entrained slag and other impurities to segregate and float to the surface where they can be, for example, absorbed into a special protective layer provided on the surface of the molten steel. Thus the tundish can be used to further "clean" the steel before it is fed to the mould for casting.

To optimize the ability of the tundish to continuously furnish a supply of clean steel to the mould, it is highly desirable to control and streamline the flow of steel through the tundish. Molten steel is normally fed to the tundish from a ladle via a shroud that protects the stream of steel from the surrounding atmosphere. The stream of molten steel from the ladle generally enters the tundish with considerable force, and this can generate considerable turbulence within the tundish itself. Any undue turbulence in the flow of molten steel through the tundish has a number of undesirable effects including, for example; preventing slag and other undesirable inclusions in the steel from agglomerating and floating to the surface; entraining into the molten steel a part of the protective crust that forms, or is specifically provided, on the surface of thereof; entraining gas into the molten steel; causing undue erosion of the refractory lining within the tundish; and generating an uneven flow of the molten steel to the casting mould.

In an effort to overcome these problems the industry has undertaken extensive research into various designs of impact pads for reducing turbulence in the tundish arising from the incoming stream of molten steel, and for optimizing the flow within the tundish to approximate ideal "plug flow" characteristics as nearly as possible of the molten steel as it traverses the tundish. In general, it has been found that the flow of molten steel through the tundish can often be improved using impact pads that have specially designed surfaces capable of redirecting and streamlining the flow of molten steel.

Plug flow behavior (i.e., passage of successive portions of steel through the tundish without significant mixing) requires direction of flow away from the tundish outlet after the molten steel recedes from the impact pad. The presence of a significant portion of flow from the impact pad to the tundish outlet, with a minimized residence time in the tundish, is known as "short-circuiting." Impact pads disclosed in the prior art have generally been designed with particular attention to the upwardly directed component of the resulting flow. An increase in the residence time, and an increase in the uniformity of residence time, in the tundish corresponds to the minimization of mixing, and enables successive steel formulations to pass through the tundish with retention of their respective compositions.

In certain configurations of a tundish, such as in a tundish feeding multiple strands, it is difficult to produce an even residence time and temperature to all strands. This is particularly difficult if the ladle shroud feeding steel into the tundish is not vertical, or is not directing steel flow at the center of the tundish, in which case both an uneven thermal distribution and uneven residence time to the various strands may result. Large variation in the thermal distribution and residence time between strands can cause operational issues and increased defects in the steel product.

Impact pads disclosed in the prior art generally comprise a base against which a downwardly directed stream of molten steel impinges, and a vertical sidewall or sidewall elements that redirect the stream. They are fabricated from refractory materials capable of withstanding the corrosive and erosive effects of a stream of molten steel for their working lives. They are frequently shaped in the form of troughs or shallow boxes having, for example, square, rectangular, trapezoidal or circular bases.

Attaining the desired flow patterns requires that the incoming stream from the ladle encounters the impact pad at a specific location, generally the geometric center of the pad. However, exact control of an incoming ladle stream is difficult, and it is not unusual for an incoming stream to be slightly off center from its desired location. A misaligned stream may cause selective erosion of one of the walls of the impact pad, or may impact, and erode, the upper surface of an impact pad, leading to undesirable flow patterns and possibly exacerbating the problems the pad was intended to overcome.

It will be appreciated that the process of designing a new tundish impact pad which meets particular pre-determined criteria is extremely complex, since changing one aspect of the design of an impact pad generally has unforeseen ramifications on the flow dynamics of the entire tundish system.

BRIEF SUMMARY OF THE INVENTION

It is an object of the present invention to provide an improved impact pad suitable for placement in a tundish for generating symmetric flow distribution of the flow of molten metal introduced therein.

The present invention provides a tundish impact pad formed from refractory material comprising a base having an impact surface which, in use, faces upwardly against a stream of molten metal entering a tundish, and a wall extending upwardly from the base around at least a part of the periphery of the impact surface. The wall comprises a plurality of adjacent wall portions. The base of the tundish impact pad has a centerline; the base may be symmetrically configured about the center line. The centerline may be a longitudinal line extending from one end of the largest horizontal dimension of the impact pad to the other end. The longitudinal center line may be nonhorizonal, having an angle of inclination or declination with respect to the horizontal plane. The longitudinal center line may comprise two segments or a plurality of segments, in which two segments, at least two segments or a plurality of segments are each nonhorizontal, or have an angle of inclination or declination with respect to the horizontal plane. The impact surface contains a planar portion or facet, extending from a wall portion towards the longitudinal center line, or to the longitudinal centerline, or towards the center of the impact surface. In certain embodiments, all lines in the facet have an inclination or declination with respect to all wall portions. In certain embodiments, the impact surface facet has an end proximal to the wall portion from which it extends and an end distal to the wall portion from which it extends, and the end distal to the wall portion terminates in a line parallel to the longitudinal center line. In certain embodiments, the impact surface facet has an end proximal to the wall portion and an end distal to the wall portion, and the end distal to the wall portion terminates in the longitudinal center line. In certain embodiments, the impact surface facet has an end proximal to the wall portion from which it extends and an end distal to the wall portion from which it extends, and the end distal to the wall portion terminates in a line parallel to the wall portion from which it extends. In certain embodiments, the impact surface facet may be described as not being contained in the horizontal plane. The impact surface facet may be nonhorizontal along a line of extent, perpendicular to the longitudinal center line, from the wall portion towards the longitudinal center line. The impact surface facet may also be described as having a nonzero angle with the horizontal between the wall portion and the longitudinal center line. The impact surface facet may also be described as either inclining or declining between the wall portion and the centerline. In certain embodiments, a line, or all lines, contained in the surface facet and extending perpendicularly from the wall portion have a nonzero angle of declination or inclination with respect to the horizontal plane, or can be characterized as not being contained in the horizontal plane. In certain embodiments, all lines contained in the surface facet and being perpendicular to lines extending perpendicularly from the wall portion have a nonzero angle of declination or inclination with respect to the horizontal plane, or can be characterized as not being contained in the horizontal plane. Certain embodiments of the invention contain an impact surface facet in which (a) all lines, contained in the surface facet and extending perpendicularly from the wall portion have a nonzero angle of declination or inclination with respect to the horizontal plane, or can be characterized as not being contained in the horizontal plane, and (b) all lines contained in the surface facet and being perpendicular to lines extending perpendicularly from the wall portion have a nonzero angle of declination or inclination with respect to the horizontal plane, or can be characterized as not being contained in the horizontal plane. Certain embodiments of the invention contain an impact surface facet in which (a) all lines, contained in the surface facet and extending in a perpendicular direction from the wall portion have a nonzero angle of declination or inclination with respect to the horizontal plane, or can be characterized as not being contained in the horizontal plane, and (b) all lines contained in the surface facet and parallel to the wall portion have a nonzero angle of declination or inclination with respect to the horizontal plane, or can be characterized as not being contained in the horizontal plane. In certain embodiments of the invention, impact surface facets in which (a) all lines, contained in the surface facet and extending perpendicularly from the wall portion have a nonzero angle of declination or inclination with respect to the horizontal plane, or can be characterized as not being contained in the horizontal plane, and (b) all lines contained in the surface facet and being perpendicular to lines extending perpendicularly from the wall portion have a nonzero angle of declination or inclination with respect to the horizontal plane, or can be characterized as not being contained in the horizontal plane, represent at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, or the entirety of the impact surface of the invention. In certain embodiments, the impact surface facet is in contact with at least two wall portions, and is inclining or declining with respect to at least two of the wall portions with which it is in contact. In certain embodiments, the impact surface facet is in contact with at least two wall portions, and at least one line contained in the surface facet and extending in a perpendicular direction from each of the at least two wall portions has a nonzero angle of declination or inclination with respect to the horizontal plane. In certain embodiments, the impact surface facet is in contact with at least two wall portions, and all lines contained in the surface facet and extending in a perpendicular direction from one of the at least two wall portions have a nonzero angle of declination or inclination with respect to the horizontal plane.

In certain embodiments of the tundish impact pad, a facet having two ends and two sides extends from two adjacent wall portions; the impact surface facet has an end proximal to a first wall portion and an end distal to the first wall portion, and the end distal to the wall portion terminates in a line parallel to the centerline; the impact surface facet has a first side proximal to a second wall portion adjacent to the first wall portion and a second side distal to the second wall portion. The impact surface facet may be nonhorizontal along a line of extent extending perpendicularly from the first wall portion to the centerline, may be nonhorizontal along a line of extent extending perpendicularly from the first side to the second side, and may be nonhorizontal both from a line of extent extending perpendicularly from the first wall portion to the centerline, and along a line of extent from the first side to the second side. In certain embodiments, the second side of the impact surface facet is perpendicular to the centerline of the pad.

In certain embodiments of the invention, the impact surface of the base contains at least two impact surface facets, of which two impact surface facets extend towards each other from opposed wall portions. In certain embodiments, the opposed wall portions are parallel. Each of the two impact surface facets may extends towards the longitudinal center line; the facets may meet at the longitudinal center line, or be separated by an area containing the centerline. In certain embodiments of the invention, the two impact surface facets meet, and the line of intersection between the two impact surface facets is horizontal. In other embodiments of the invention, the line of intersection between the two impact surface facets is not horizontal, and has a lower end and an upper end. In certain embodiments of the invention, the line of intersection between the two impact surface facets is equidistant from two opposed walls.

In certain embodiments of the invention, the impact surface of the base contains a plurality of facets extending from respective wall portions towards the center of the impact surface, and all lines in the plurality of facets, or all lines contained in the plurality of surface facets and extending in a perpendicular direction from a wall portion, have an inclination or declination with respect to all wall portions, and the plurality of facets has an area of at least 35%, at least 30%, at least 35% at least 40%, at least 45%, at least 50%, at least 55%, at least 60%, at least 65%, at least 70%, at least 75%, at least 80%, at least 85%, at least 90%, at least 95%, or 100% of the area of the impact surface.

In certain embodiments of the invention, the impact surface of the base contains at least four impact surface facets; four impact surface facets meet at a base impact surface center point.

The base of the impact pad can be of any suitable shape, for example, polyhedral shapes having in the horizontal plane, for example, square, rectangular, trapezoidal, rhomboidal, hexagonal, octagonal or other polygonal geometries, or circular or elliptical geometries. In embodiments in which the base of the pad has a polyhedral shape, a plurality of wall portions may extend upwards from the base; each wall portion may extent upward from separate line segment constituting the polygon. In embodiments in which the base is rectangular, the impact pad may comprise two pairs of impact surface facets, wherein each impact surface facet extends inwardly from a pair of adjacent wall portions; the longitudinal center line may comprise a central peak or may comprise terminal peaks; and pairs of impact surface facets may intersect along a latitudinal line that may comprise a central peak or may comprise terminal peaks.

The wall may extend partially around the periphery of the base, or may extend around the entire periphery of the base. In certain embodiments wherein the wall extends around the entire periphery of the base, the wall has a uniform height. The wall may be vertical or have an angle in the range from, and including, 1 degree to, and including, 30 degrees from the vertical. In embodiments in which the pad is polygonal, a portion of the wall between two vertices may have a non-uniform height. For example, the portion of the wall may have a minimum height at the center of the portion of the wall.

One or more portions of the upper part of the wall may support one or more overhangs which project inwardly over the periphery of the base. The overhangs may be continuous around the periphery of the base, or may be discontinuous around the periphery of the base. In certain embodiments, inner surfaces of the overhang meeting at a vertex of the wall may be connected by a plane angle geometry, a radius geometry or a chamfer geometry.

One or more portions of the wall may contain ports. In certain embodiments, the impact surface may have an upper end and a lower end, and the ports may be provided at the lower end of the impact pad. In certain embodiments, one or more pairs of ports may be provided on faces of opposing wall portions adjacent to a wall portion located at the lower end of the impact surface. A port may be provided so that the bottom of the port has the same elevation as the portion of the impact surface in communication with the port.

Angles of declination or inclination, with respect to the horizontal plane, of impact surface facets as measured from a wall towards the centerline of the impact pad may range from and including 1 degree to and including 20 degrees, or from and including 1 degree to and including 15 degrees. The angle of declination or inclination, with respect to the horizontal plane, of the impact surface center line may range from and including 1 degree to and including 20 degrees, or from and including 1 degree to and including 15 degrees.

The percentage of the impact surface covered by impact surface facets having angles of declination or inclination, with respect to the horizontal plane, as measured both on a line perpendicular to a wall with which the facet is in communication and on a line parallel to the same wall, may range from and including 25% to and including 100%, from and including 30% to and including 100%, and from and including 40% to and including 100%, In a first embodiment of the invention, two pairs of impact surface facets meet at a central vertical plane of the impact surface extending in the larger horizontal dimension of the impact pad, and at a central vertical plane of the impact surface extending in the smaller horizontal dimension of the impact pad. The impact pad has a rectangular geometry in the horizontal plane, with a pair of larger opposing wall portions and a pair of smaller opposing wall portions. Each facet has an angle of declination as it extends from a larger opposing wall portion. Each facet has an angle of inclination as it extends from a smaller opposing wall portion. The top of the wall is provided with an overhang that extends over the impact surface of the impact pad.

In a second embodiment of the invention, two pairs of impact surface facets meet at a central vertical plane of the impact surface extending in the larger horizontal dimension of the impact pad, and at a central vertical plane of the impact surface extending in the smaller horizontal dimension of the impact pad. The impact pad has a rectangular geometry in the horizontal plane, with a pair of larger opposing wall portions and a pair of smaller opposing wall portions. Each facet has an angle of declination as it extends from a larger opposing wall portion. Each facet has an angle of declination as it extends from a smaller opposing wall portion. The top of the wall is provided with an overhang that extends over the impact surface of the impact pad.

In a third embodiment of the invention, two pairs of impact surface facets meet at a central vertical plane of the impact surface extending in the larger horizontal dimension of the impact pad, and at a central vertical plane of the impact surface extending in the smaller horizontal dimension of the impact pad. The impact pad has a rectangular geometry in the horizontal plane, with a pair of larger opposing wall portions and a pair of smaller opposing wall portions. Each facet has an angle of inclination as it extends from a larger opposing wall portion. Each facet has an angle of inclination as it extends from a smaller opposing wall portion. The top of the wall is provided with an overhang that extends over the impact surface of the impact pad.

In a fourth embodiment of the invention, two pairs of impact surface facets meet at a central vertical plane of the impact surface extending in the larger horizontal dimension of the impact pad, and at a central vertical plane of the impact surface extending in the smaller horizontal dimension of the impact pad. The impact pad has a rectangular geometry in the horizontal plane, with a pair of larger opposing wall portions and a pair of smaller opposing wall portions. Each facet has an angle of inclination as it extends from a larger opposing wall portion. Each facet has an angle of declination as it extends from a smaller opposing wall portion. The top of the wall is provided with an overhang that extends over the impact surface of the impact pad. The smaller opposing wall portions have central height minima. The interior surfaces of portions of the overhang are joined by beveled segments, or join at right angles, or are joined by radii.

In a fifth embodiment of the invention, a pair of impact surface facets meet at a central vertical plane of the impact surface extending in the larger horizontal dimension of the impact pad. The impact pad has a rectangular geometry in the horizontal plane, with a pair of larger opposing wall portions and a pair of smaller opposing wall portions. One of the smaller opposing wall portions constitutes a front wall; the other of the smaller wall portions constitutes a back wall. Each facet has an angle of declination as it extends from a larger opposing wall portion. Each facet has an angle of declination as it extends from the front wall to the back wall. The larger opposing wall portions decrease in height as they extend from the back wall to the front wall. The top of the wall is provided with an overhang that extends over the impact surface of the impact pad. The interior surfaces of portions of the overhang are joined by beveled segments, or join at right angles, or are joined by radii.

In a sixth embodiment of the invention, a pair of impact surface facets meet at a central vertical plane of the impact surface extending in the larger horizontal dimension of the impact pad. The impact pad has a trapezoid geometry in the horizontal plane, with the smaller of the two parallel wall portions constituting a back wall and the larger of the two parallel wall portions constituting a front wall. One of the smaller opposing wall portions constitutes a front wall; the other of the smaller wall portions constitutes a back wall. Each of the pair of facets has an angle of declination as it extends towards the other facet from a nonparallel wall. Each facet has an angle of declination as it extends from the back wall to the front wall. The nonparallel wall portions decrease in height as they extend from the back wall to the front wall. The top of the wall is provided with an overhang that extends over the impact surface of the impact pad. The interior surfaces of portions of the overhang are joined by beveled segments, or join at right angles, or are joined by radii. Ports extend from the interior of the wall to the exterior of the wall; each of a pair of ports may extend through wall portions adjacent to the front wall at a location in the wall portion adjacent to the front wall.

The base itself can, if desired, be affixed to the base of a tundish using any suitable means, for example, using refractory cement, or by locating the base by means of corresponding elements formed in the surface of the refractory lining of the tundish and the underside of the impact pad. The impact pad may be embedded into the refractory base of the tundish. This can be achieved, for example, by placing the impact pad on the monolithic refractory lining of a tundish, placing a layer of cold cure or hot cure refractory power composition to surround the base and optionally part of the outer wall of the impact pad, and then curing the refractories to bind the impact pad in position in the tundish.

The wall extending upwardly from the base around at least a part of the periphery of the impact surface may be made from the same material as the base and may be integral therewith. At least one wall extending upwardly from the base around at least a part of the periphery of the impact surface may have a mirror image counterpart wall extending upwardly from the opposite peripheral part of the base.

In the case that the impact pad has a rectangular or trapezoidal-shaped base and is intended for so called "single strand" operation, the wall may extend around three sides of the base, with the fourth side having either no wall, or a relatively low wall.

If the wall of the impact pad is provided with an overhang, the upper surfaces of the overhang may be smooth surfaces. The upper surface can have a profile matching the profile of the under-surface if desired, e.g. to provide an overhang having a substantially uniform thickness at least in the portion occupied by the curved or sloping portion.

The junction between the wall and the impact surface (i.e. the upper surface of the base) can take the form of a sharp angle, e.g. a right angle, or an acute angle or an obtuse angle, or can be rounded or curved.

The impact pad according to the present invention can be made using the standard molding techniques well known in the art for forming refractory shaped articles. The impact pad can, if desired, be fabricated in two or more separate parts which can then be joined together to form the final article, or can be fabricated as a monolithic structure (i.e., formed in one piece as a single integral article).

The refractory material from which the impact pad is fabricated can be any suitable refractory material capable of withstanding the erosive and corrosive effects of a stream of molten metal throughout its working life. Examples of suitable materials are refractory concretes, for example concretes based on one or more particulate refractories, and one or more suitable binders. Refractories suitable for the manufacture of impact pads are well known in the art, for example alumina, magnesia and compounds or composites thereof. Similar suitable binders are well known in the art, for example, high alumina cement.

Impact pads in accordance with the present invention can be made for use with tundishes operating in single strand, two strand or multi strand mode. As is well known in the art, continuous casting steel processes operating in single strand and multi strand (delta tundish) modes generally employ impact pads having square, rectangular or trapezoidal cross section (in the horizontal plane) wherein one pair of opposite sides are provided with walls having equal height, a third side also having a wall, and the fourth side either having a lower wall or no wall. In the double (or sometime quadruple or six-fold) strand technologies, the impact pads generally have square or rectangular cross section wherein a first pair of opposite sides are provided with walls having equal height, and the second pair of opposite sides are also of equal height (which may be the same as, or different from the height of the first pair). In single strand and multiple strand operation the impact pad is generally positioned near one end of the tundish to one side of the area wherein the outlet(s) for the molten steel are situated, whereas in double strand operation the impact pad is generally positioned in the center of a rectangular tundish with two outlets situated on opposite sides of the impact pad (or in quadruple strand operation, two pairs of outlets situated on opposite sides, or in six-fold strand operation, three pairs of outlets situated on opposite sides).

Impact pads in accordance with the present invention can be used, for example, to provide symmetric flow patterns in tundishes for holding molten steel, and to minimize problems associated with non-vertical, or non-centered, introduction of molten metal into the impact pad.

BRIEF DESCRIPTION OF THE SEVERAL VIEWS OF THE DRAWINGS

The invention will now be described with reference to the accompanying drawings wherein.

DETAILED DESCRIPTION OF THE INVENTION

Figure 1:
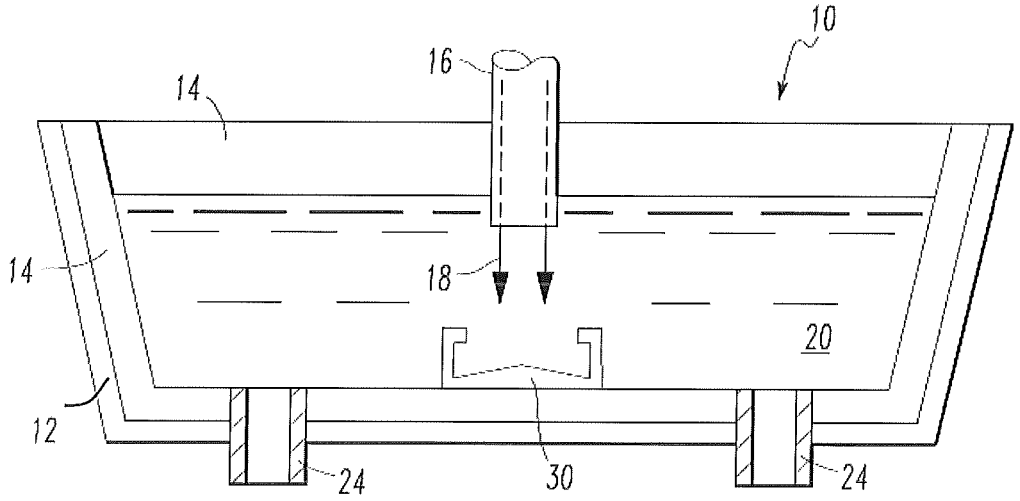
FIG. 1 is a cross-sectional view of a tundish, showing an impact pad according to the present invention on the bottom thereof.

FIG. 1 shows a conventional tundish 10 for use in a steel making process. Tundish 10 has an outer metallic shell 12 and an inner refractory lining 14. A ladle shroud 16 is positioned above tundish 10 to direct a stream 18 of molten metal from a ladle (not shown) into an impact pad 30 in tundish 10 to form a molten metal bath 20. Tundish 10 includes a pair of well blocks 24 to allow molten metal from bath 20 to enter molds (not shown).

Figure 2:
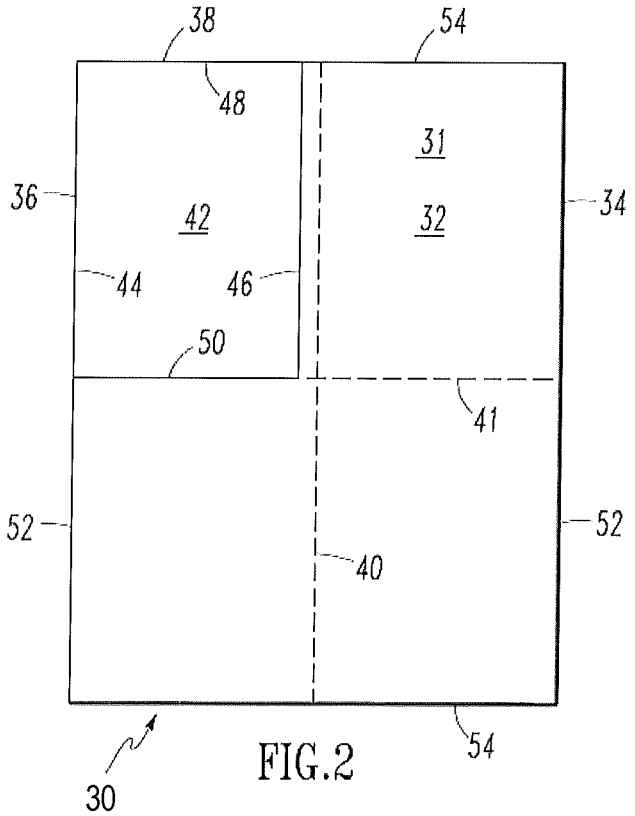
FIG. 2 is a plan view, from above, of an impact pad of the present invention.

FIG. 2 shows a plan view of an impact pad 30 of the present invention. Base 31 has an impact surface 32; wall 34 extends upwardly from the impact surface 32. First wall portion 36 and second wall portion 38 are adjoining portions of wall 34; in this embodiment they meet at a right angle, but may meet at other nonzero angles in other embodiments. Centerline 40 is a line on impact surface 32 that is equidistant from each of a pair of opposing wall portions. Facet 42 is a planar portion of impact surface 32 that extends inwardly from first wall portion 36 towards centerline 40 between facet end 44 proximal to first wall portion 36 and facet end 46 distal to first wall portion 36, and extends inwardly from second wall portion 38 between facet side 48 proximal to second wall portion 38, and facet side 50 distal to second wall portion 38. In the embodiment depicted in FIG. 2, base 31 is rectangular in horizontal section, and wall 34 comprises two larger opposing wall portions 52 from which centerline 40 is equidistant, and two smaller opposing wall portions 54.

Figure 3:
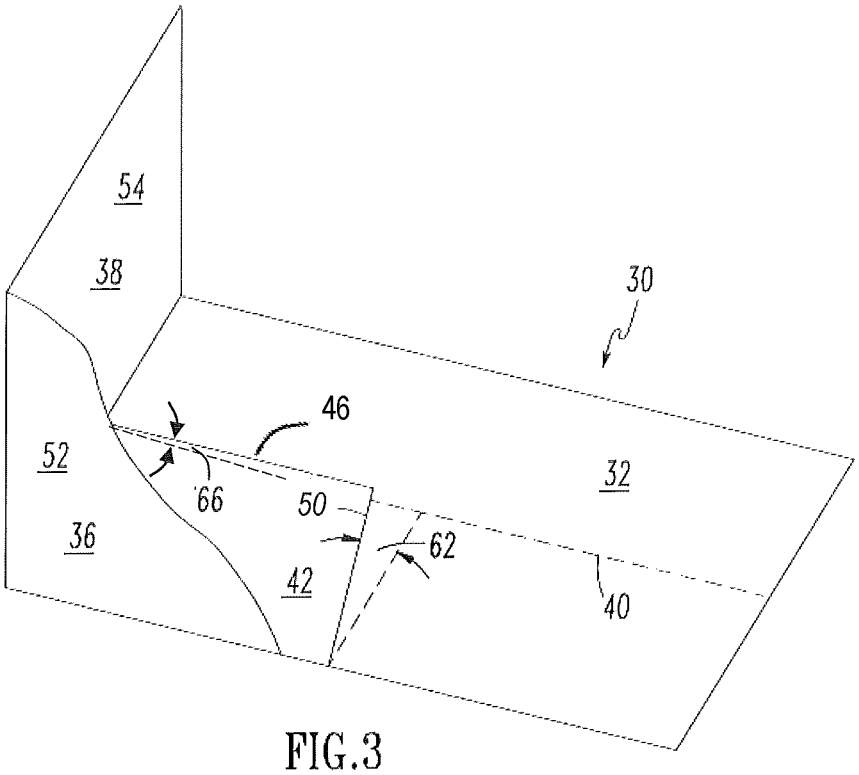
FIG. 3 is a perspective plan view of an impact pad of the present invention.

FIG. 3 shows a perspective plan view of an impact pad 30 of the present invention. Impact surface 32 is the upper face of impact pad 30. A cutaway portion of first wall portion 36 is shown extending upwardly from impact surface 32. Second wall portion 38, adjacent to first wall portion 36, is shown extending upwardly from impact surface 32. Facet 42 extends inwardly from first wall portion 36 towards centerline 40; facet side 50 distal to second wall portion 38 forms an angle of latitudinal elevation 62 with the horizontal plane. Facet 42 extends inwardly from second wall portion 38; facet side 46 distal to first wall portion 36 forms an angle of longitudinal elevation 66 with the horizontal plane.

Figure 4:
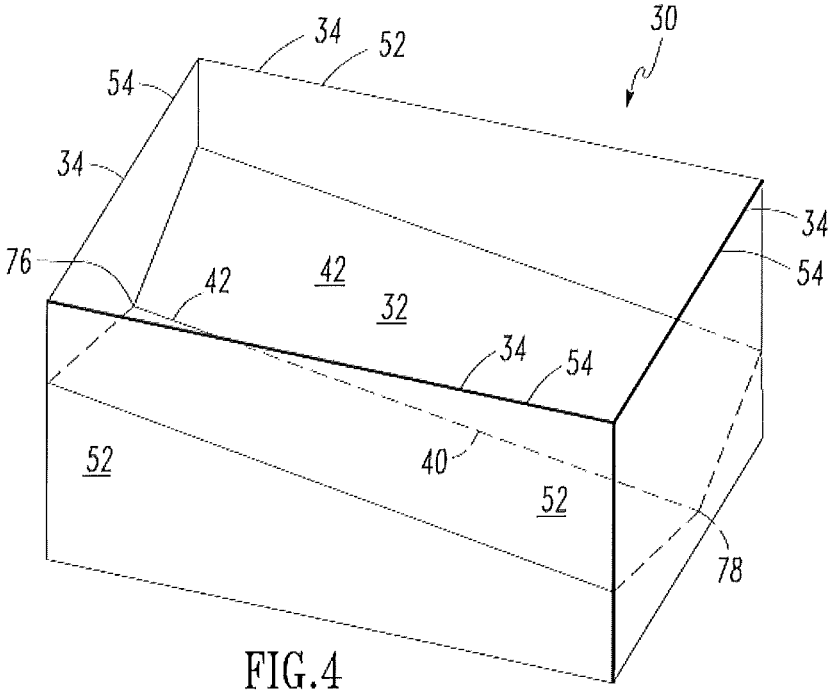
FIG. 4 is a perspective plan view of an impact pad of the present invention.

FIG. 4 shows a perspective plan view of an impact pad 30 of the present invention. Impact surface 32 is the upper face of impact pad 30. Wall 34, extending upwardly from impact surface 32, comprises two opposing longitudinal wall portions 52 and two opposing latitudinal wall portions 54. In this embodiment, impact surface 32 is divided, along centerline 40, into two facets 42, each extending inwardly and downwardly from a respective longitudinal wall portion 52 and each extending from a first opposing latitudinal wall portion 54 to a second opposing latitudinal wall portion 54. Centerline 40 extends downwardly from upper end of centerline 76 at wall 54 to lower end of centerline 78 at wall 34. Each facet 42 has an upper end adjacent to longitudinal centerline upper end 76 and a lower end adjacent to longitudinal centerline lower end 78.

Figure 5:
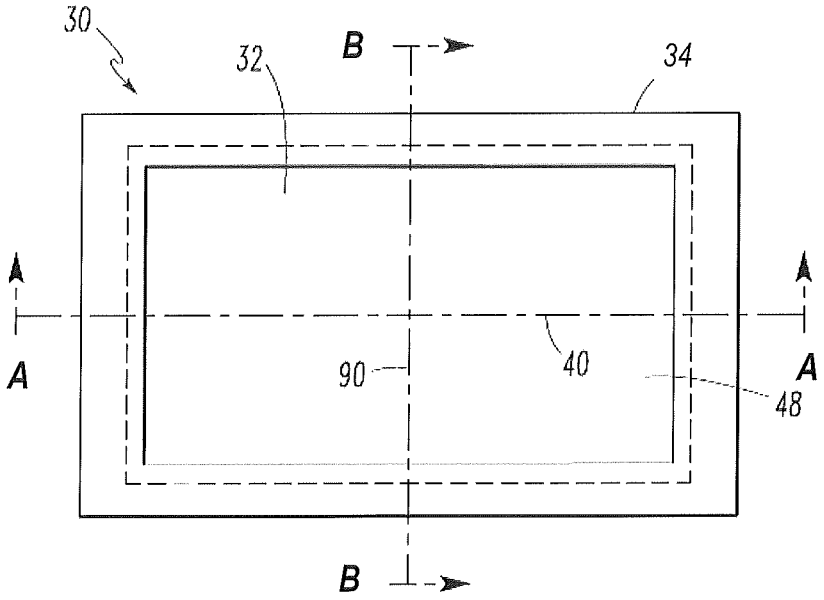
FIG. 5 is a plan view, from above, of an impact pad of the present invention.

FIG. 5 provides a top plan view of an impact pad 30 of the invention. Impact surface 32 is the upper face of impact pad 30. Wall 34 extends upwardly from, and surrounds, impact surface 32. Impact surface 32 is divided longitudinally by longitudinal centerline 40, and latitudinally by transverse centerline 90. Section A-A views are views across the length of the impact pad; section B-B views are views across the width of the impact pad.

Figure 6:
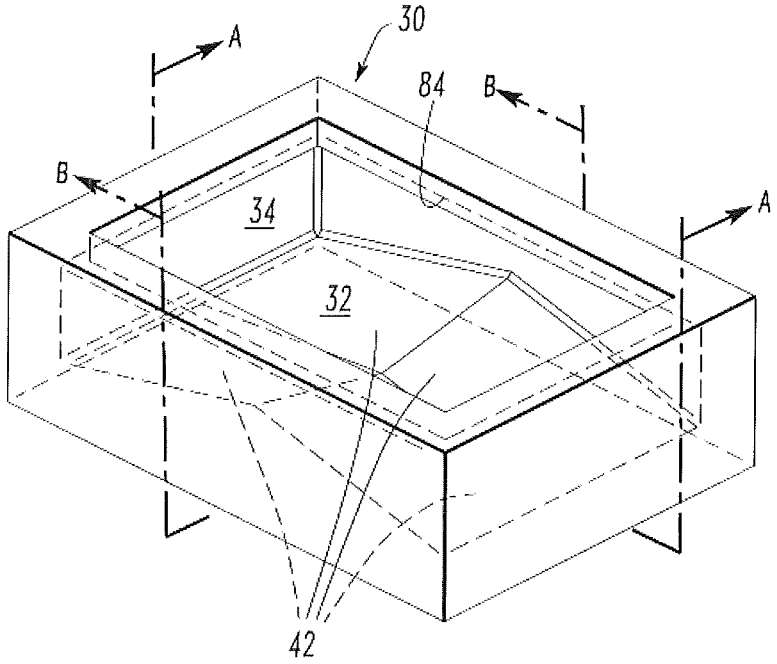
FIG. 6 is a perspective drawing of an impact pad of the present invention.

FIG. 6 is a perspective view of a first envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 34.

Figure 7:
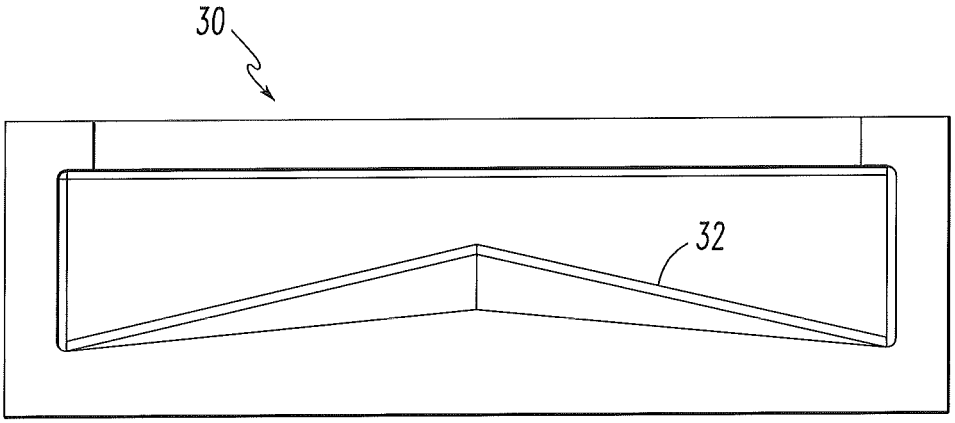
FIG. 7 is a cross-sectional view of an impact pad of the present invention.

FIG. 7 is a sectional view, along section line A-A, of the impact pad 30 of FIG. 6. In this section, impact surface 32 contains a central peak.

Figure 8:
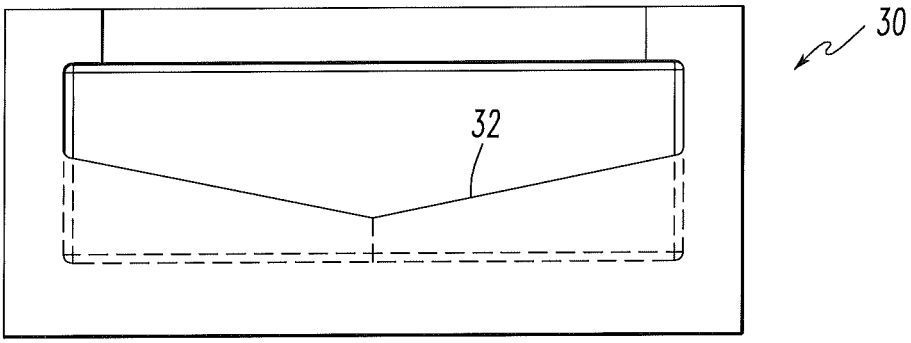
FIG. 8 is a cross-sectional view of an impact pad of the present invention.

FIG. 8 is a sectional view, along section line B-B, of the impact pad 30 of FIG. 6. In this section, impact surface 32 contains a central minimum and peaks at the intersections with the wall.

Figure 9:
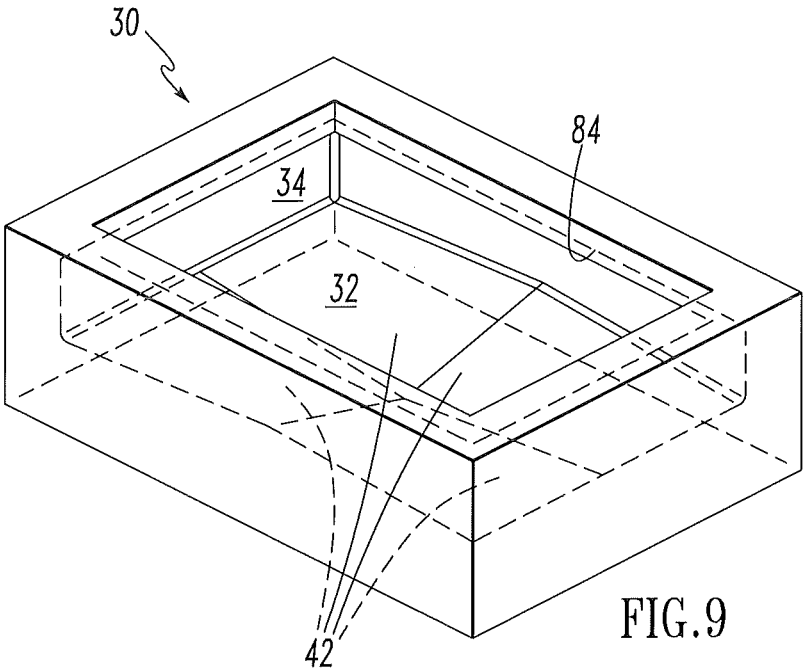
FIG. 9 is a perspective drawing of an impact pad of the present invention.

FIG. 9 is a perspective view of a second envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 34.

Figure 10:
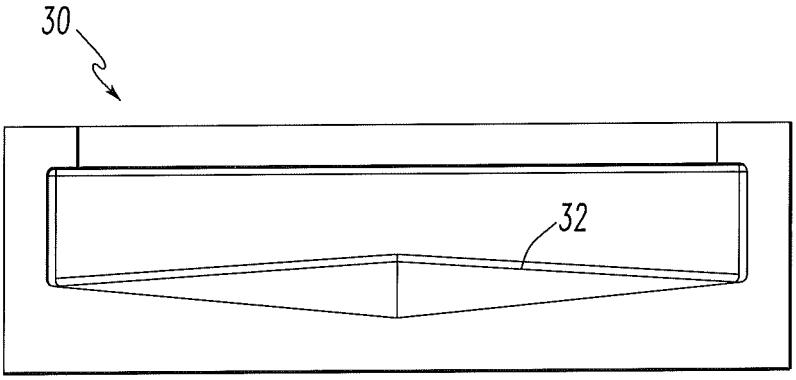
FIG. 10 is a cross-sectional view of an impact pad of the present invention.

FIG. 10 is a sectional view, along section line A-A, of the impact pad 30 of FIG. 9. In this section, impact surface 32 contains a central minimum and peaks at the intersections with the walls.

Figure 11:
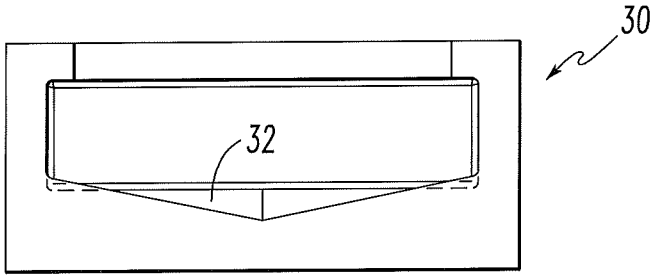
FIG. 11 is a cross-sectional view of an impact pad of the present invention.

FIG. 11 is a sectional view, along section line B-B, of the impact pad 30 of FIG. 9. In this section, impact surface 32 contains a central minimum and peaks at the intersections with the walls.

Figure 12:
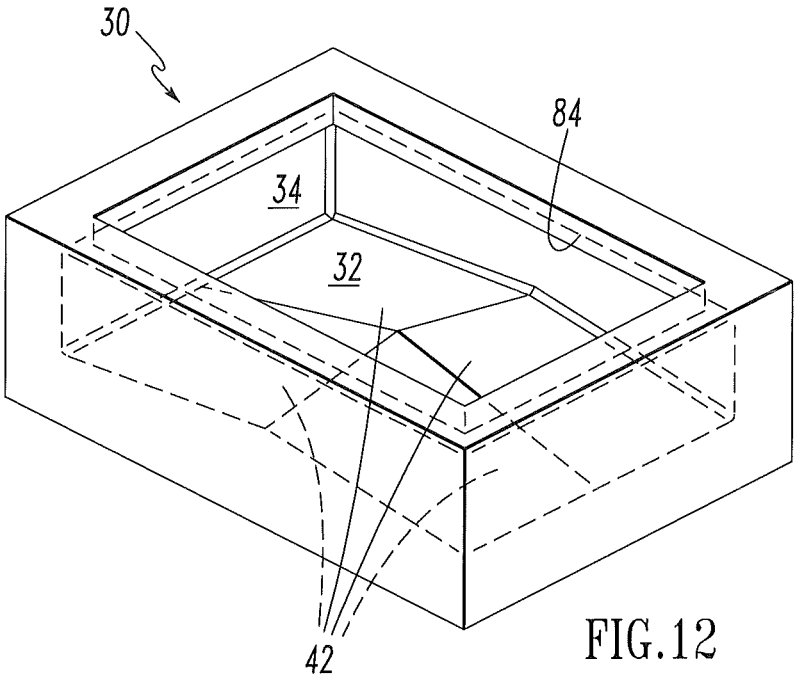
FIG. 12 is a perspective drawing of an impact pad of the present invention.

FIG. 12 is a perspective view of a third envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 34.

Figure 13:
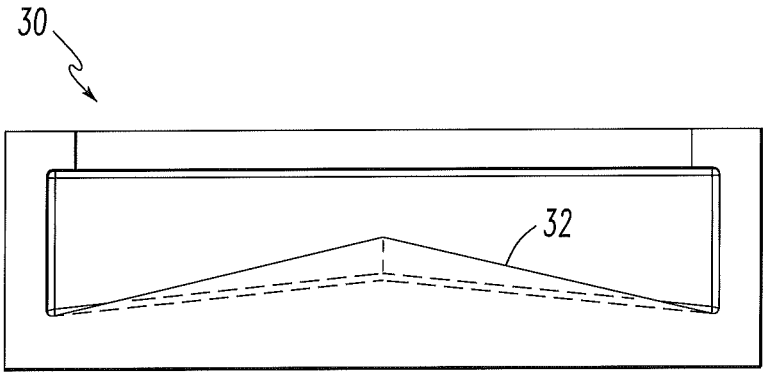
FIG. 13 is a cross-sectional view of an impact pad of the present invention.

FIG. 13 is a sectional view, along section line A-A, of the impact pad 30 of FIG. 12. In this section, impact surface 32 contains a central maximum and minima at the intersections with the walls.

Figure 14:
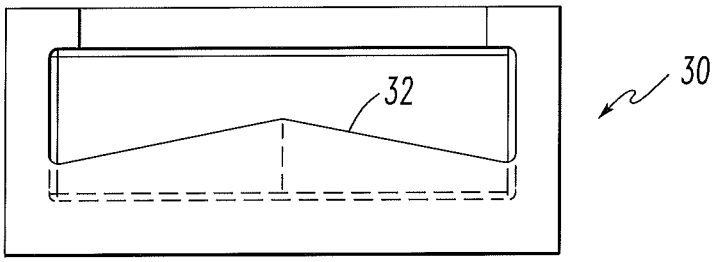
FIG. 14 is a cross-sectional view of an impact pad of the present invention.

FIG. 14 is a sectional view, along section line B-B, of the impact pad 30 of FIG. 12. In this section, impact surface 32 contains a central maximum and minima at the intersections with the walls.

Figure 15:
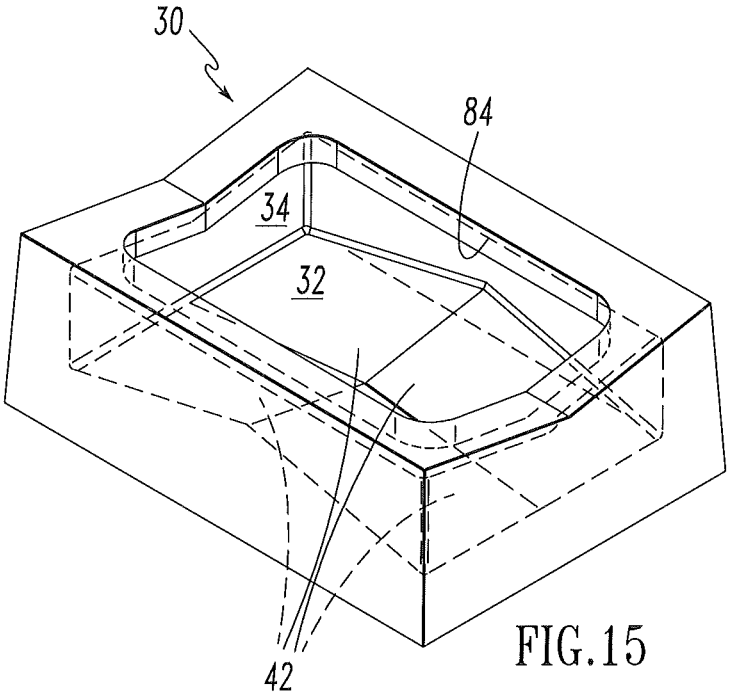
FIG. 15 is a perspective drawing of an impact pad of the present invention.

FIG. 15 is a perspective view of a fourth envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 34.

Figure 16:
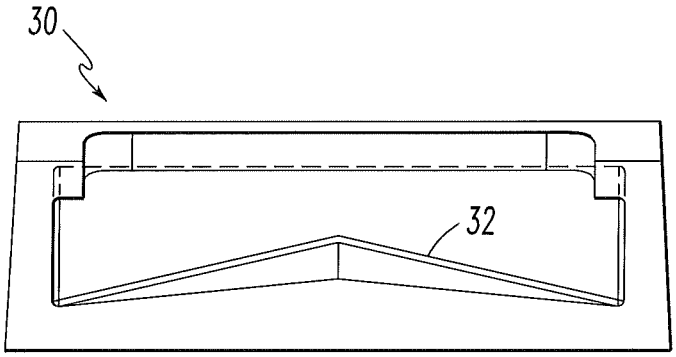
FIG. 16 is a cross-sectional view of an impact pad of the present invention.

FIG. 16 is a sectional view, along section line A-A, of the impact pad 30 of FIG. 15. In this section, impact surface 32 contains a central maximum and minima at the intersections with the walls.

Figure 17:
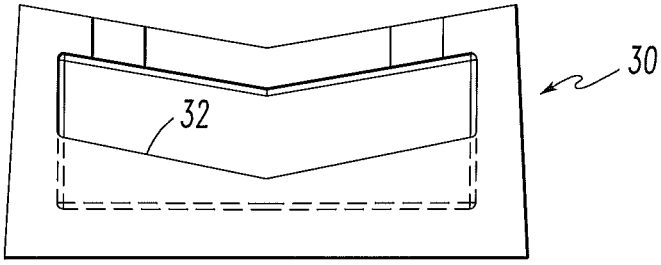
FIG. 17 is a cross-sectional view of an impact pad of the present invention.

FIG. 17 is a sectional view, along section line B-B, of the impact pad 30 of FIG. 15. In this section, impact surface 32 contains a central minimum and maxima at the intersections with the walls.

Figure 18:
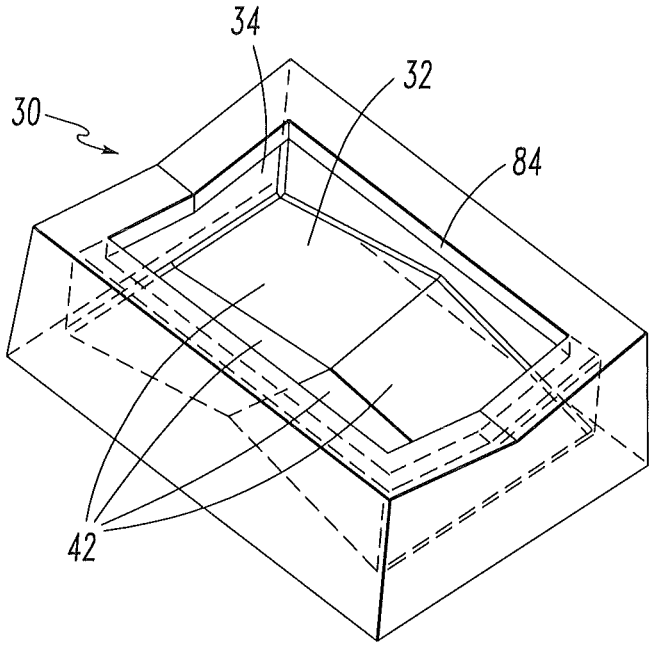
FIG. 18 is a perspective drawing of an impact pad of the present invention.

FIG. 18 is a perspective view of a variation of the fourth envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 34. Wall 34 has a central minimum height in the latitudinal direction. The portions of overhang 84 extending inwardly from adjacent portions of wall 34 meet at an angle equivalent to the angle of intersection of the adjacent portions of wall 34 from which they extend.

Figure 19:
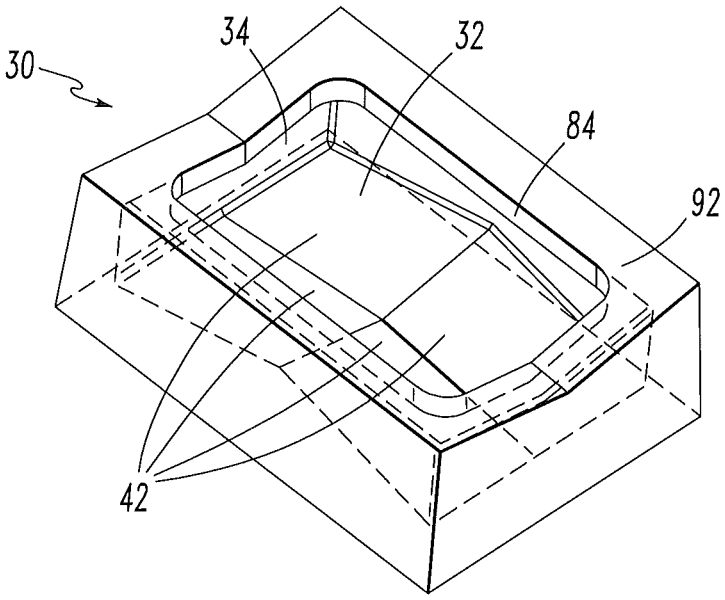
FIG. 19 is a perspective drawing of an impact pad of the present invention.

FIG. 19 is a perspective view of a variation of the fourth envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 54. Wall 34 has a central minimum height in the latitudinal direction. The portions of overhang 84 extending inwardly from adjacent portions of wall 54 have intersections characterized by corner radii 92.

Figure 20:
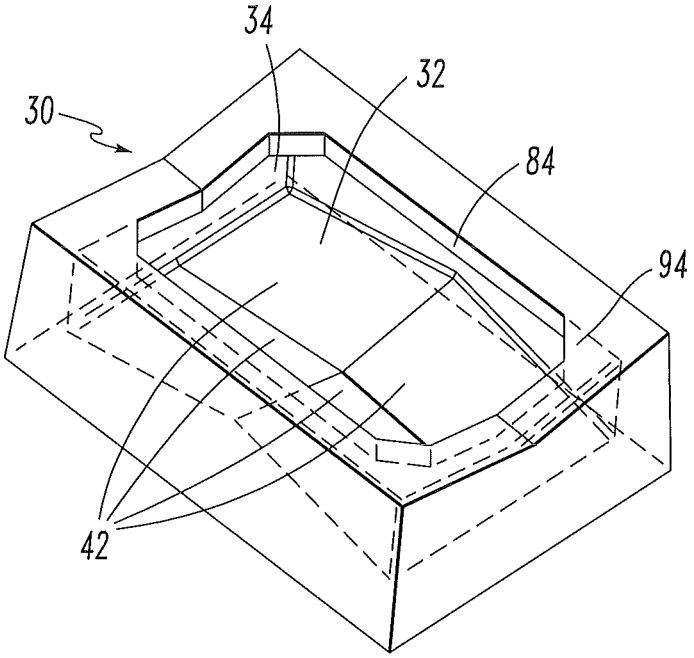
FIG. 20 is a perspective drawing of an impact pad of the present invention.

FIG. 20 is a perspective view of a variation of the fourth envisionment of an impact pad 30 of the invention. Impact surface 32 is the upper face of impact pad 30. Impact surface 32 is divided into four facets 42. Wall 34 extends upwardly from impact surface 32. Overhang 84 extends inwardly from wall 34. Wall 34 has a central minimum height in the latitudinal direction. The portions of overhang 84 extending inwardly from adjacent portions of wall 34 have intersections characterized by corner chamfers 94.

Figure 21:
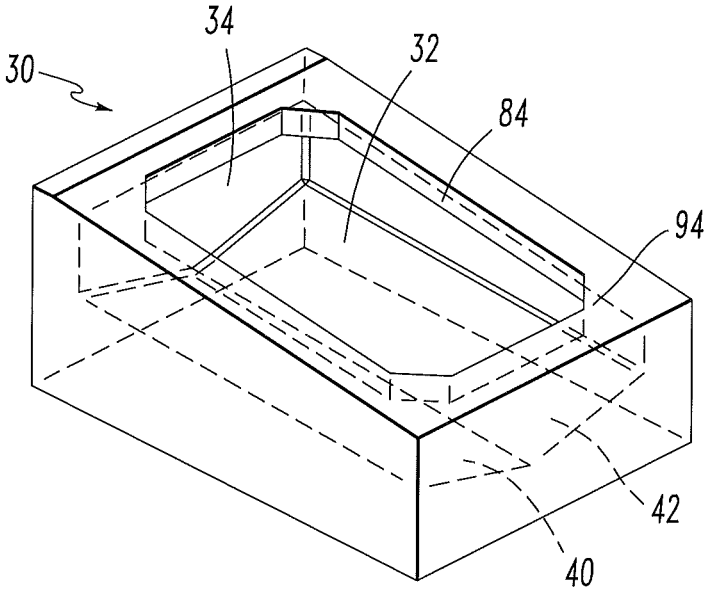
FIG. 21 is a perspective drawing of an impact pad of the present invention.

FIG. 21 is a perspective view of a fifth envisionment of an impact pad 30 of the invention. Impact surface 32 is the upper face of impact pad 30. Impact surface 32 is divided into two facets 42, intersecting at longitudinal centerline 40. Wall 34 extends upwardly from impact surface 32. Overhang 84 extends inwardly from wall 34. The portions of overhang 84 extending inwardly from adjacent portions of wall 34 have intersections characterized by corner chamfers 94.

Figure 22:
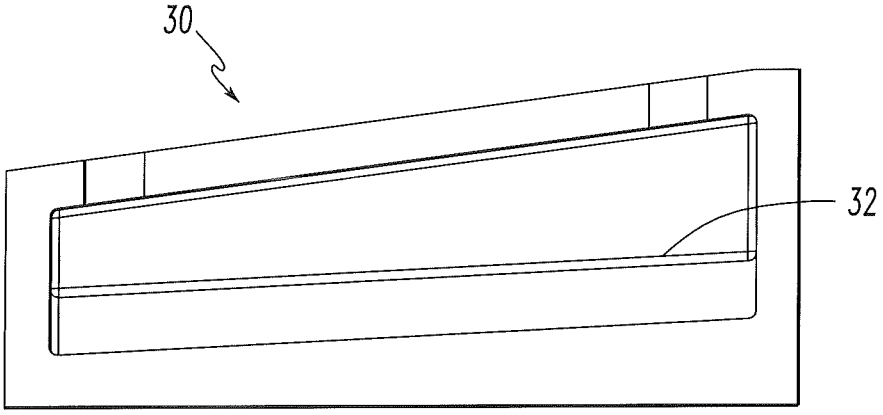
FIG. 22 is a cross-sectional view of an impact pad of the present invention.

FIG. 22 is a sectional view, along section line A-A, of the impact pad 30 of FIG. 21. In this section, impact surface 32 exhibits a slope between the interior of a front wall and the interior of a back wall.

Figure 23:
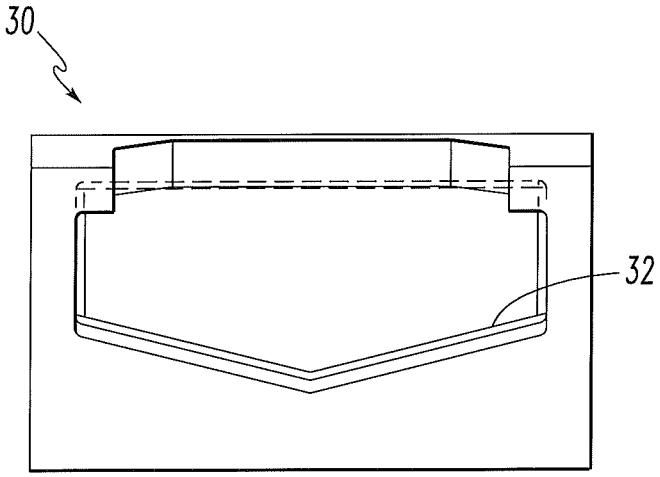
FIG. 23 is a cross-sectional view of an impact pad of the present invention.

FIG. 23 is a sectional view, along section line B-B, of the impact pad 30 of FIG. 21. In this section, impact surface 32 contains a central minimum and maxima at the intersections with the walls.

Figure 24:
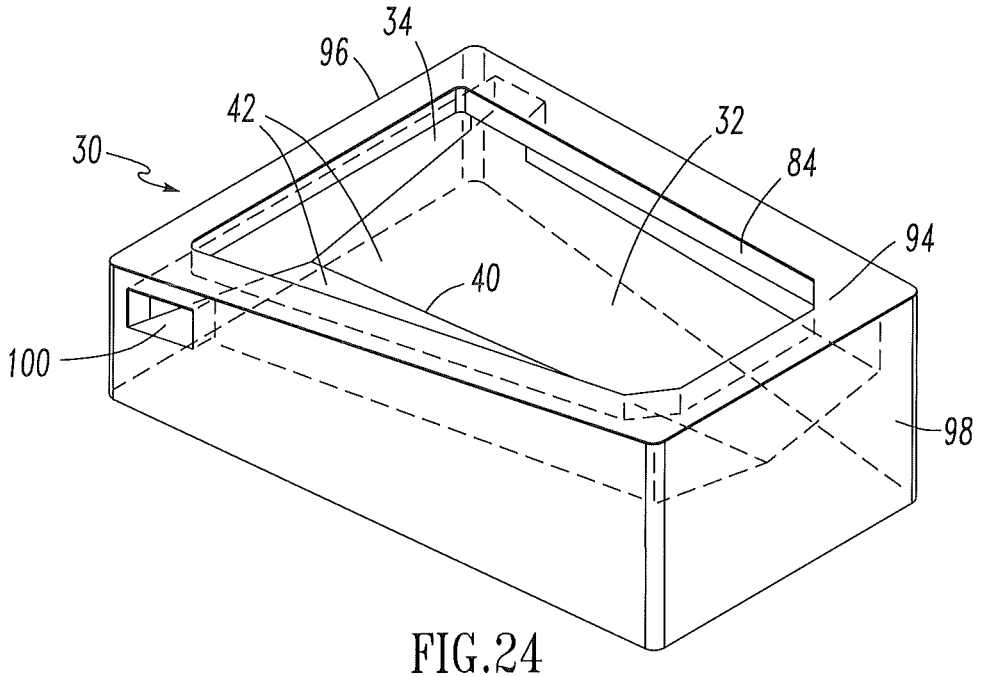
FIG. 24 is a perspective drawing of an impact pad of the present invention.

FIG. 24 is a perspective view of a sixth envisionment of an impact pad 30 of the invention. The base of impact pad 30 is in the shape of a trapezoid. Impact surface 32 is the upper face of impact pad 30. Impact surface 32 is divided into two facets 42, intersecting at longitudinal centerline 40. Wall 34 extends upwardly from impact surface 32. Overhang 84 extends inwardly from wall 34. Two of the portions of overhang 84 extending inwardly from adjacent portions of wall 34 have intersections characterized by corner chamfers 94. Each of facets 42 is in communication with a front wall portion 96 and a back wall portion 98. Each of two facets 42 extends at an angle inclined with respect to the horizontal from a front wall portion 96 to a back wall portion 98; the intersection of each of facets 42 with back wall portion 98 is elevated with respect to the intersection each of facets 42 with respect to front wall portion 96. Front wall portion 96 is the longer of the two parallel wall portions of impact pad 30; back wall portion 98 is the shorter of the two parallel wall portions of impact pad 30. Ports 100 extend from the interior of wall 34 to the exterior of wall 34; each extends through a wall portion adjacent to front wall portion 96 at a location in the wall portion adjacent to front wall portion 96. Transverse latitudinal lines in impact surface 32 have terminal peaks.

Figure 25:
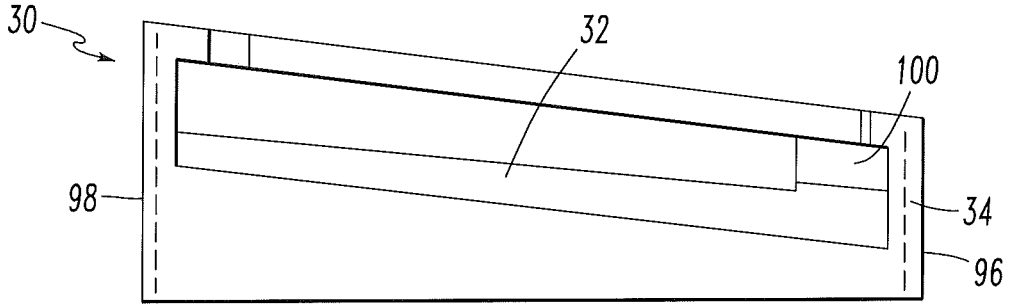
FIG. 25 is a cross-sectional view of an impact pad of the present invention.

FIG. 25 is a sectional view, along section line A-A, of the impact pad 30 of FIG. 24. In this section, impact surface 32 exhibits an incline between the interior of front wall 96 and back wall 98. Port 100 passes through a portion of wall 34 at its intersection with front wall 96. The bottom of port 100 is coplanar with the portion of impact surface 32 with which it is in communication.

Figure 26:
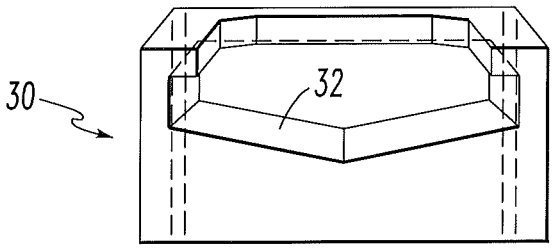
FIG. 26 is a cross-sectional view of an impact pad of the present invention.

FIG. 26 is a sectional view, along section line B-B, of the impact pad 30 of FIG. 24. In this section, impact surface 32 contains a central minimum and maxima at the intersections with the walls.

Figure 27:
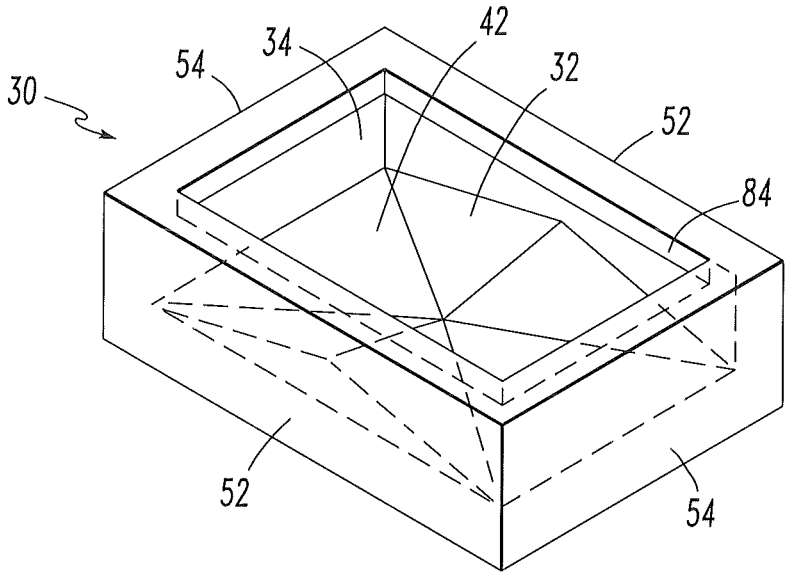
FIG. 27 is a perspective drawing of an impact pad of the present invention.

FIG. 27 is a perspective view of a seventh envisionment of an impact pad 30 of the invention. Impact surface 32 is the upper face of impact pad 30. Impact surface 32 is divided into six facets 42. Two pairs of facets extend inwardly towards the longitudinal center line; each facet of a pair of facets extends from one of two longitudinal opposing wall portions 52, and each facet of another pair of facets extends from the other of two longitudinal opposing wall portions 52. Each of a third pair of facets extends inwardly towards the other facet; each facet extends inwardly from one of a pair of latitudinal opposing wall portions 54 along the longitudinal center line. Wall 34 extends upwardly from impact surface 32. Overhang 84 extends inwardly from wall 54.

Figure 28:
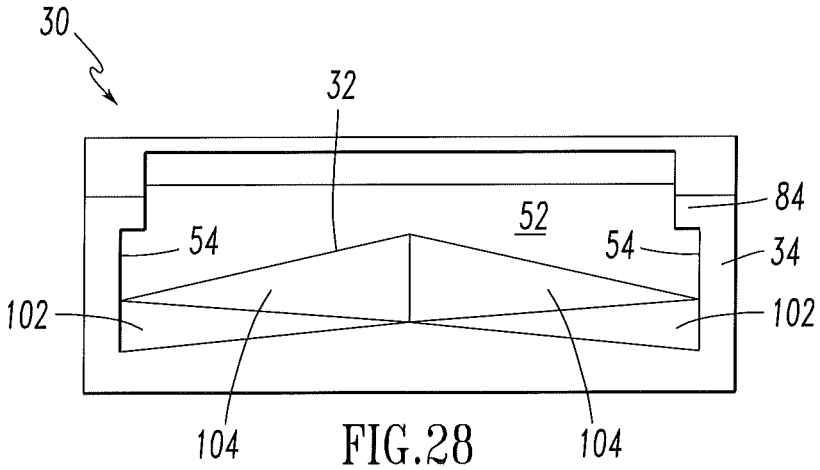
FIG. 28 is a perspective view of a section of an impact pad of the present invention.

FIG. 28 is a perspective cutaway view, along A-A, of the envisionment of the impact pad 30 of the invention shown in FIG. 27. Impact surface 32 is the upper face of impact pad 30. Wall 34 extends upwardly from impact surface 32. Each of two latitudinally level, longitudinally inclined facets 102 extends inwardly from each of two latitudinally opposing wall portions 54. Facets 104 that are both latitudinally and longitudinally inclined extend inwardly from each of two longitudinally opposing wall portions 52. Overhang 84 extends inwardly from wall 34 over the interior of impact pad 30.

Figure 29:
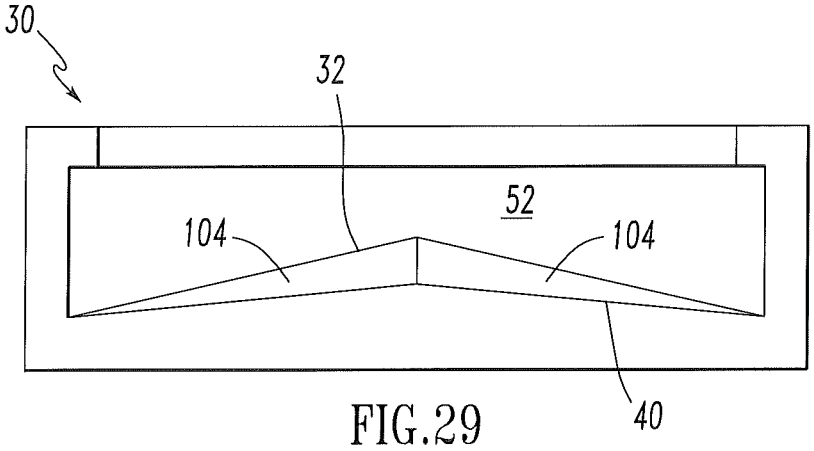
FIG. 29 is a cross-sectional view of an impact pad of the present invention.

FIG. 29 is a sectional view, along section line A-A, of the impact pad 30 of FIG. 27. In this section, impact surface 32 contains a central maximum and minima at the intersections with the walls. The central maximum along longitudinal center line 40 has a lower elevation than the maximum of the intersection of latitudinally and longitudinally inclined facets 104 with longitudinally opposed wall portions 52

Figure 30:
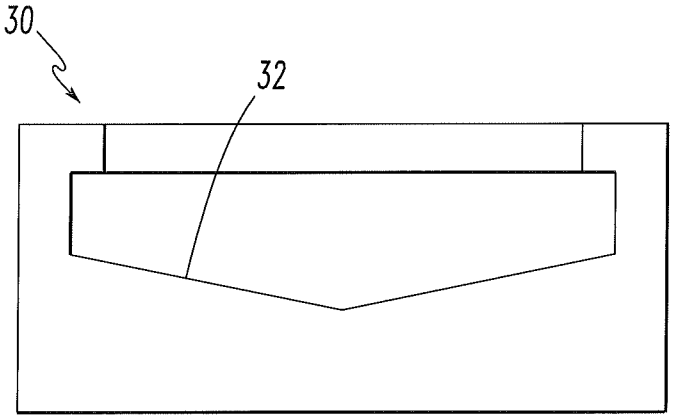
FIG. 30 is a cross-sectional view of an impact pad of the present invention.

FIG. 30 is a sectional view, along section line B-B, of the impact pad 30 of FIG. 27. In this section, impact surface 32 contains a central minimum and maxima at the intersections with the walls.

Also contemplated is the use of an impact pad according to the invention, comprising (a) placing an impact pad according to the invention within a refractory vessel and arranging it so as to receive a flow of molten metal, and (b) directing the flow of molten metal into the interior of the impact pad. A method for reducing the effects of misalignment of an impinging stream of molten steel entering a refractory vessel comprises (a) placing an impact pad according to the invention within a refractory vessel and arranging it so as to receive a flow of molten metal, and (b) directing the flow of molten metal into the interior of the impact pad.

Numerous modifications and variations of the present invention are possible. It is, therefore, to be understood that within the scope of the following claims, the invention may be practiced otherwise than as specifically described.

ELEMENTS

10. Tundish or refractory vessel
12. Outer metallic shell
14. Inner refractory lining
16. Ladle shroud
18. Molten metal
20. Molten metal bath
24. Well block
30. Impact pad
31. Impact pad base
32. Impact surface
34. Wall
36. First wall portion
38. Second wall portion
40. Longitudinal center line
42. Facet
44. Facet end proximal to first wall portion
46. Facet end distal to first wall portion
48. Facet side proximal to second wall portion
50. Facet side distal to second wall portion
52. Longitudinal opposing wall portions
54. Latitudinal opposing wall portions
62. Angle with horizontal plane of extent from first wall portion
66. Angle with horizontal plane of extent from second wall portion
76. Upper end of longitudinal center line
78. Lower end of longitudinal center line
84. Overhang
90. Transverse center line
92. Corner radius
94. Chamfer
96. Front wall
98. Back wall
100. Port
102. Latitudinally level, longitudinally inclined facet
104. Latitudinally and longitudinally inclined facet

We claim:

1. An impact pad comprising refractory material, the impact pad comprising:

(a) a base having a shape selected from the group consisting of rectangular and trapezoid, having a larger horizontal dimension, and having an impact surface facing upwardly;

(b) a wall extending upwardly from the base around the entire periphery of the base, wherein the wall comprises a plurality of adjacent wall portions meeting at a nonzero angle;

wherein the wall comprises two larger opposing longitudinal wall portions and two smaller opposing latitudinal wall portions;

wherein the impact surface comprises a longitudinal center line equidistant from the two larger opposing wall portions;

wherein the longitudinal center line declines from a first opposing latitudinal wall portion to a second opposing latitudinal wall portion at an impact surface lower end;

wherein the impact surface contains a facet extending from a wall portion towards the longitudinal center line;

wherein the surface facet is in contact with at least two wall portions, and is inclining or declining with respect to at least two of the wall portions with which it is in contact;

wherein the surface facet comprises an end proximal to a first wall portion and an end distal to the first wall portion, and the end distal to the first wall portion terminates in a line parallel to the longitudinal center line;

wherein angles of declination or inclination, with respect to the horizontal plane, of surface facets as measured from the wall towards the longitudinal center line of the impact pad have a value from and including 1 degree to and including 15 degrees;

wherein the angle of declination or inclination, with respect to the horizontal plane, of the longitudinal center line has a value from and including 1 degree to and including 15 degrees;

wherein the base is symmetrically configured with respect to the longitudinal center line;

wherein two impact surface facets extend towards each other and downwardly from opposing longitudinal wall portions;

wherein the two impact surface facets meet at the longitudinal center line; and;

wherein the wall of the impact pad is provided with an overhang.

2. An impact pad according to claim 1, wherein the impact surface consists of two facets.

3. An impact pad according to claim 2, wherein each facet has an angle of declination as it extends from a larger opposing longitudinal wall portion.

4. An impact pad according to claim 1, wherein a latitudinal wall portion of has a minimum height at the center of the latitudinal portion of the wall.

5. An impact pad according to claim 1, wherein the portions of the wall intersect at vertices;

wherein a first smaller opposing wall portion comprises a front wall;

wherein a second smaller opposing wall portion comprises a back wall;

wherein a pair of impact surface facets meet at a central vertical plane extending in a larger horizontal dimension of the impact pad;

wherein each impact surface facet extends from the front wall to the back wall;

wherein a wall portion has nonuniform height between vertices; and wherein the impact pad is rectangular in the horizontal plane.

6. An impact pad according to claim 1, wherein the impact pad base is trapezoidal;

wherein a pair of impact surface facets meets at a central vertical plane of the impact surface extending in the larger horizontal dimension of the impact pad;

wherein the wall comprises a front wall portion and a back wall portion;

wherein the back wall portion has a shorter length than the front wall portion;

wherein the front wall portion and the back wall portion are parallel;

wherein each of two facets is in communication with the front wall portion and the back wall portion; and wherein ports extend from the interior of the wall to the exterior of the wall.

7. An impact pad according to claim 6, wherein the ports are provided at the lower end of the impact surface.

8. Method for reducing the effects of misalignment of an impinging stream of molten steel entering a refractory vessel, comprising:

(a) placing an impact pad according to claim 1 within a refractory vessel and arranging it so as to receive a flow of molten metal; and (b) directing the flow of metal into the interior of the impact pad.

* * * * *